US012716610B2

(12) United States Patent
Isaacson et al.

(10) Patent No.: US 12,716,610 B2
(45) Date of Patent: Aug. 25, 2026

(54) FLOOR VENT ASSEMBLY

(71) Applicants: Gen-X Engineering Solutions, Inc., Wixom, MI (US); Michael LaFrance, Milford, MI (US)

(72) Inventors: Troy Isaacson, Wixom, MI (US); Kyle Isaacson, Wixom, MI (US); Michael LaFrance, Milford, MI (US)

(73) Assignee: Gen-X Engineering Solutions, Inc., Wixom, MI (US)

( * ) Notice: Subject to any disclaimer, the term of this patent is extended or adjusted under 35 U.S.C. 154(b) by 529 days.

(21) Appl. No.: 18/140,245

(22) Filed: Apr. 27, 2023

(65) Prior Publication Data

US 2024/0353143 A1 Oct. 24, 2024

Related U.S. Application Data

(60) Provisional application No. 63/460,295, filed on Apr. 18, 2023.

(51) Int. Cl.
*F24F 13/08* (2006.01)
*F24F 13/12* (2006.01)

(52) U.S. Cl.
CPC ..... *F24F 13/084* (2013.01); *F24F 13/12* (2013.01)

(58) Field of Classification Search
CPC ..... F24F 13/068; F24F 13/084; F24F 13/12
See application file for complete search history.

(56) References Cited

U.S. PATENT DOCUMENTS

| | | | | |
|---|---|---|---|---|
| 1,559,376 A | | 10/1925 | Riker | F24F 13/18 454/195 |
| 2,995,079 A | * | 8/1961 | La Fontaine | F24F 13/12 454/292 |
| 3,443,507 A | | 5/1969 | Harcourt | |
| D279,601 S | | 7/1985 | Sexton | D23/388 |
| D315,790 S | | 3/1991 | Koessler | D23/388 |
| D339,415 S | | 9/1993 | Kiras | D23/397 |
| D353,193 S | | 12/1994 | Porter | D25/48.8 |
| D362,059 S | | 9/1995 | Wojcik | D25/48.1 |

(Continued)

FOREIGN PATENT DOCUMENTS

| | | |
|---|---|---|
| CN | 201258582 Y | 6/2009 |
| EP | 3124869 B1 | 1/2018 |
| WO | 2018225498 | 12/2018 |

OTHER PUBLICATIONS

"NPL.HitAndMiss.Amazon.co.uk" Jun. 20, 2013, Amazon.co.uk, site visited Aug. 16, 2024: https://www.amazon.co.uk/Stainless-Steel-Louvre-Ventilation-Cover/dp/B00DIBP0VM (Year: 2013).

(Continued)

*Primary Examiner* — Steven S Anderson, II
(74) *Attorney, Agent, or Firm* — Timothy Engling

(57) ABSTRACT

A floor vent assembly with slots for airflow having a structure and interaction between an air vent and a slider with an actuator extending through the air vent to permit manual sliding of the slider in the floor vent assembly to selectively open/restrict the air vent for airflow. The floor vent assembly may also have an internal structural plate with corresponding slots. The user simply manually moves the actuator and thus the slider within the floor vent assembly where respective slots align or are offset to allow or restrict the flow of air through the floor vent assembly.

8 Claims, 8 Drawing Sheets

(56) References Cited

U.S. PATENT DOCUMENTS

| | | | | |
|---|---|---|---|---|
| 5,472,380 | A * | 12/1995 | Sarazen, Jr. | F24F 13/085 454/324 |
| 5,597,392 | A | 1/1997 | Hawkins | F24F 13/28 55/DIG. 35 |
| 5,792,230 | A | 8/1998 | Moore | B01D 46/0004 55/DIG. 35 |
| D416,997 | S | 11/1999 | Prouty | D23/397 |
| 6,302,784 | B1 | 10/2001 | Berger | |
| 6,340,329 | B1 * | 1/2002 | Park | F24F 13/085 454/324 |
| 6,945,867 | B2 * | 9/2005 | Park | F24F 13/12 454/324 |
| D536,778 | S | 2/2007 | O'Hagin | D23/393 |
| 8,425,288 | B1 | 4/2013 | Snipes, Jr. | |
| 9,341,388 | B2 | 5/2016 | Francescon | |
| 9,744,847 | B2 | 8/2017 | Anderson et al. | |
| 10,641,518 | B2 | 5/2020 | Kennedy | |
| 10,982,875 | B2 | 4/2021 | Myers et al. | |
| D948,021 | S | 4/2022 | Morton | D23/366 |
| D1,001,261 | S | 10/2023 | Xu | D23/388 |
| 2004/0074214 | A1 | 4/2004 | Henson | |
| 2012/0260593 | A1 | 10/2012 | Gower, Sr. | E04B 1/7076 52/302.1 |
| 2014/0302770 | A1 | 10/2014 | Song | |
| 2015/0072610 | A1 | 3/2015 | Coles | F24F 13/12 454/324 |
| 2015/0260427 | A1 | 9/2015 | Snyder | |
| 2017/0219243 | A1 | 8/2017 | Yi | F24F 11/30 |
| 2017/0268227 | A1 | 9/2017 | Yasinskiy | F24F 13/06 |
| 2022/0299236 | A1 | 9/2022 | Hurt | F24F 13/20 |
| 2022/0333816 | A1 | 10/2022 | Norris | F24F 13/084 |
| 2023/0204250 | A1 | 6/2023 | Smith | F24F 13/084 454/289 |

OTHER PUBLICATIONS

Tate, Tate Product Brochure, Jan. 13, 2023, pp. 62-63.

* cited by examiner

FLOOR VENT ASSEMBLY

CROSS REFERENCE TO RELATED APPLICATIONS

This application claims priority benefit of U.S. provisional patent application 63/460,295 filed on 18 Apr. 2023, which is incorporated herein by reference. A U.S. design application Ser. No. 29/890,787, filed Apr. 27, 2023, is seeking to protect ornamental aspects of the top portion of the floor vent.

FIELD OF THE DISCLOSURE

This disclosure relates to a floor vent assembly including a slider movable relative to an air vent to allow airflow in an open position and restrict airflow in a second position. More specifically, the disclosure relates to a floor vent assembly that does not have portions extending above a face surface of the air vent cover, including an actuator to move the slider within the floor vent assembly.

BACKGROUND

Registers and grilles help regulate airflow to and from an HVAC unit, such as a central heating or cooling unit. Home ventilation units typically have both supply and return/exhaust applications where return applications often include a grille covering an opening in the wall. Grilles are the vents through which air is pulled out of a room for circulation back to an HVAC unit. Grilles are usually not designed to hold the weight of a person and typically do not have any type of damper to regulate airflow. Grilles do not have dampers behind the slats to close off the flow of air as maximum return air flow is usually preferred.

In contrast, floor vents, sometimes called registers, are placed above or in air duct openings in floors at the end of HVAC ducts where air flows into a room through the floor. Such openings in the floor where a floor vent/register fits into are typically four inches by ten inches (101.6×254 mm) (sometimes 4 inches×12 inches) often with a ledge around a rectangular opening for the floor vent or register to rest when in place. Many prior floor vents are raised above the surrounding floor surface, including wide borders on the protruding face plate to compensate for oversized floor openings, while some air vents are designed to fit into a floor opening more precisely. Those designed to fit into a floor opening are typically slightly undersized to ensure that they fit into the floor opening without protruding above the surrounding floor surface.

Registers typically have a damper, rather than just a grille or air vent. Adjustable rotatable louvers below an air vent often allow for airflow control as dampers. Such a louvered damper enables control of airflow through the vent/register. Dampers or louvers allow control of airflow by opening and closing the vent, such as the common rotating flap below the air vent cover.

U.S. Pat. No. 1,064,518 discloses a vent cover assembly with a support plate configured to be secured over a duct, and a flush mount vent cover, each with a plurality of airflow apertures. The airflow apertures can be aligned when the vent cover is installed in a first position overlying the support plate, and the vent cover may obstruct the first airflow apertures when the vent cover is in a second installed position overlying the support plate. The vent cover assembly 100a may be opened and closed by lifting out of the assembly, rotating 180 degrees, and reinstalling the vent cover 106. This vent cover assembly does not protrude above the surrounding floor surface when installed, and it allows the adjustment of airflow through the vent by lifting, rotating, and installing the vent cover in differing orientations.

Keeping air properly circulating and concealing duct openings with decorative or blending vent assemblies help keep each room at a comfortable temperature while not being obtrusive with raised vent assemblies that stand out, visually or structurally.

SUMMARY

The focus of this disclosure is floor vent assembly that is simple but effective in regulating airflow into a room while preferably remaining flush to the surrounding floor surface, in one manner by fitting inside an opening in the floor and blending with the surrounding floor surface. The disclosed floor vent assembly may also rest on top of the surrounding floor surface with the outer surface slightly raised above the surrounding floor surface.

The present disclosure provides a simple floor vent assembly that includes an air vent, a slider and optionally a support bracket. The air vent, slider, and internal support bracket can be the only three integral functional components of the floor vent assembly. The simplicity of its structure in ideally only having three components reinforces an inventive aspect of the disclosed floor vent assembly. In certain embodiments, depending on the construction, a support bracket is not needed.

The disclosed floor vent assembly makes it easy to change airflow by simply moving an actuator, such as a tab, which in turn moves the slider relative to the air vent. One aspect is that the sliding feature is simple to operate, and it avoids rotating mechanisms to adjust a damper component or a louver where an actuator extends above the vent.

In a preferred embodiment, a floor vent assembly includes an air vent having a center aperture and a plurality of slots between vent ribs. On a back side of the air vent, a lip has a series of elongated slider track apertures in parallel portions of the lip. The floor vent assembly also has a molded plastic slider with numerous slider slots with slider ribs between certain slider slots, and the slider further has guides along outer rims and the actuator, preferably formed in a single integrated molded component. Each guide is aligned with a corresponding elongated slider track aperture to allow the slider to slide relative to the air vent where the parallel lip portions form a track for the slider. The floor vent assembly also preferably has a support bracket molded into the air vent, wherein the support bracket extends beyond the lip for reinforcement of the entire floor vent assembly. The actuator of the slider passes through the aperture of the air vent to allow a user to internally slide the slider from a first position, where the slots of the air vent align with the slider slots to allow the flow of air, to a second position, where the slider ribs align with the slots of the air vent to restrict the flow of air through the floor vent assembly.

The floor vent assembly can be adapted to be used flush with the surrounding floor surface. As such, the air vent never needs to be raised above the floor surface, and the actuator need not extend beyond the outer surface of the air vent in any movement to slide the slider.

The disclosed innovative, versatile, easy-to-use, simple floor vent assembly is affordable with minimal parts and cost-effective manufacturing options, such as plastic molded parts, rather than all steel or aluminum.

BRIEF DESCRIPTION OF THE DRAWINGS

The above-mentioned and other features of this disclosure and the manner of obtaining them will become more apparent, and the disclosure itself will be best understood by reference to the following descriptions of floor vent assemblies and associated methods considered in conjunction with the accompanying figures, which are given as non-limiting examples only, in which.

The exemplifications set out herein illustrate embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiments in different forms, the figures show, and herein described in detail, embodiments with the understanding that the present descriptions are to be considered exemplifications of the principles of the disclosure and are not intended to be exhaustive or to limit the disclosure to the details of construction and the arrangements of components and steps set forth in the following description or conveyed in the figures.

Floor vents or registers are ideal in a cool climate where heating a home is a key concern. As warm air rises, the heat coming out of a floor vent warms a room as it ascends.

As disclosed, a floor vent assembly 12 is both functional and visually appealing. The floor vent assembly 12 can withstand the weight of foot traffic and furniture. It is preferably flush with the surrounding floor surface so as to not catch on socks or furniture while being able to handle the weight of either. A preferred floor vent assembly 12 is rectangular as shown to both fit standard openings in the floors or rest on top of the surrounding floor, as well as to facilitate linear movement of a slider 16, but other shapes are within the scope of this disclosure.

A floor vent assembly 12 includes an air vent 14 and a slider 16 as shown in FIGS. 1, 2, 3, 4, and 13. A preferred support bracket 18 can be incorporated into the floor vent assembly 12. As will be detailed more below, the slider 16 may move relative to the air vent 14 within the floor vent assembly 12 from a first position that allows airflow through the floor vent assembly 12 to a second position that restricts or blocks the flow of air through the floor vent assembly 12.

Figure 1:
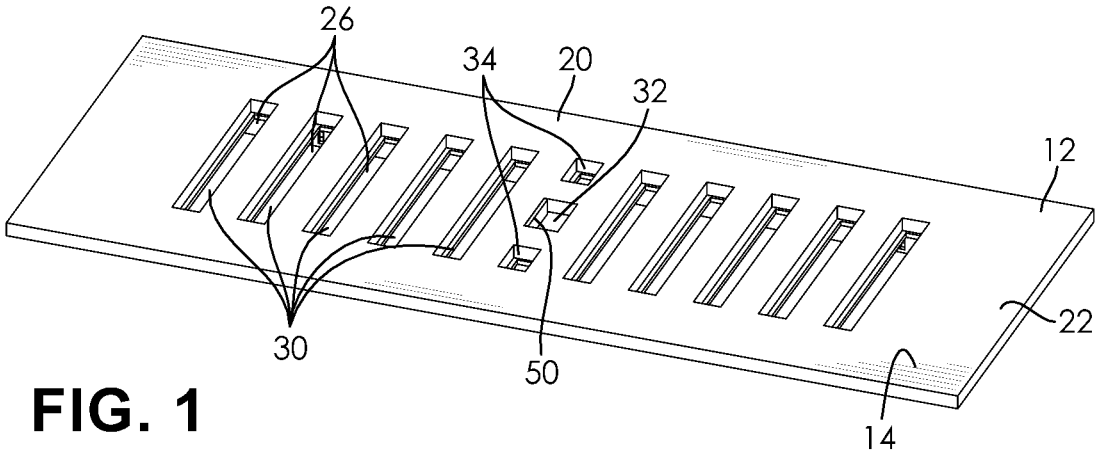
FIG. 1 shows a perspective view of a top of a floor vent assembly in an open position.
Figure 2:
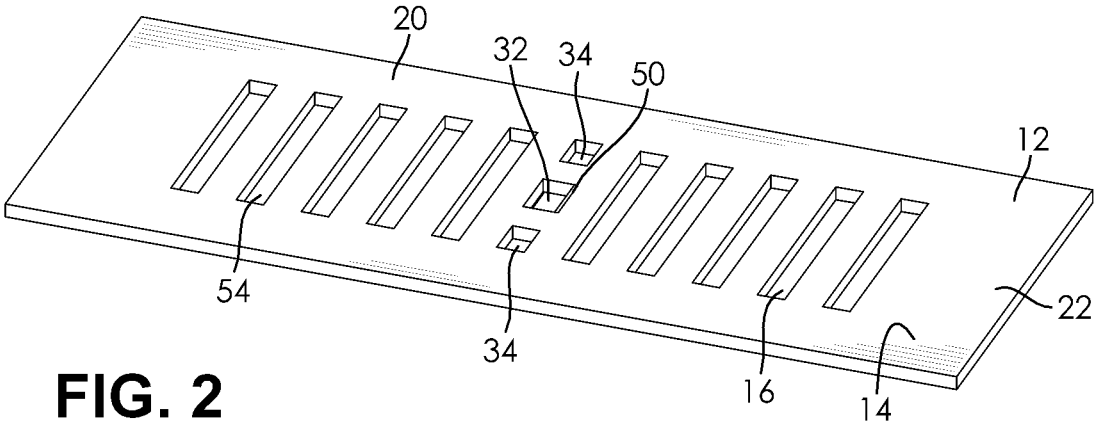
FIG. 2 shows a perspective view of the top of the floor vent assembly in a closed position.
Figure 3:
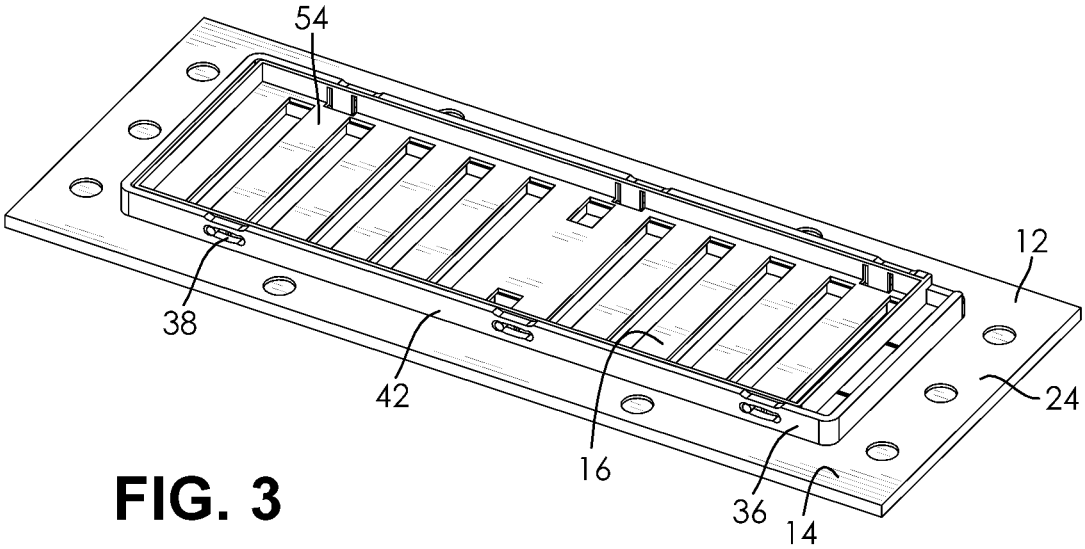
FIG. 3 shows a bottom perspective view of the floor vent assembly in the open position.
Figure 4:
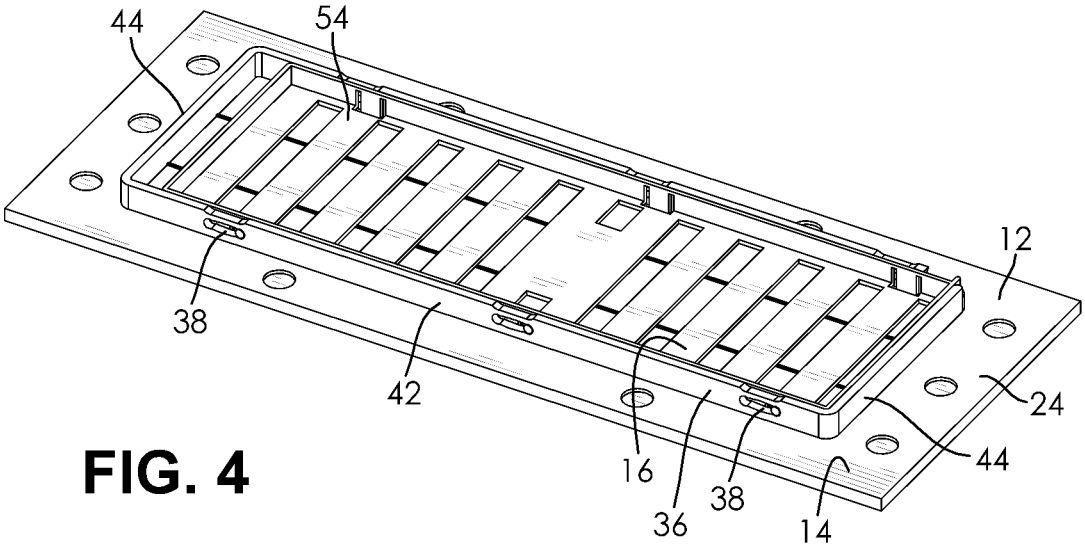
FIG. 4 shows a bottom perspective view of the floor vent assembly in the closed position.

FIG. 1 shows a top view of a floor vent assembly 12 in an open position with the actuator 50 to the left as would be seen as installed. FIG. 2 shows a top view of the floor vent assembly 12 in a closed position with the actuator 50 to the right. FIG. 3 shows a bottom view of the floor vent assembly 12 in the open position as would be the underside when installed in a surrounding floor. FIG. 4 shows a bottom view of top of a floor vent assembly 12 in the closed position.

The air vent 14 includes a vent cover 20 with an outer surface 22 with an opposite back side 24. The air vent 14 includes a plurality of slots 26 including ten elongated slots 30 as shown in a preferred embodiment with a center aperture 32. The air vent 14 is preferably molded at least in part from plastic as a single integrated piece. The number of slots 30 is a design choice, including two smaller slots 34 adjacent to the center aperture 32. The slots 26, 30, and 34 are designed for air to flow through.

The back side 24 of the air vent 14 includes a lip 36 extending from the back side 24. The lip 36 includes a plurality of slider track apertures 38, with preferably at least two on each parallel portion 42 of the lip 36, but ideally six as shown in FIGS. 3, 4, 5, 8, 9, and 14. The slider track apertures 38 are preferably elongated, such as 11 mm long, parallel to the lip 36. Each slider track aperture 38 preferably has a detent 40 on each distal end of each slider track aperture 38. The detents 40 on each distal end of each slider track aperture 38 are designed so that each guide 52 in each slider track aperture 38 can remain set in a fully open or a fully closed position at respective distal ends of the slider track aperture 38.

Figure 8:
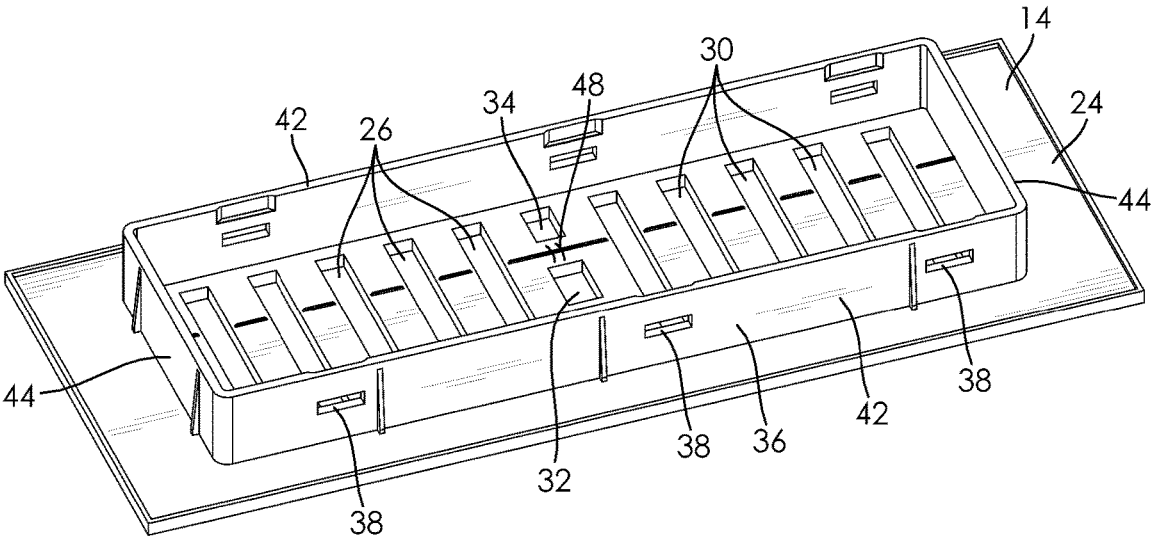
FIG. 8 shows a bottom perspective view of an air vent.
Figure 9:
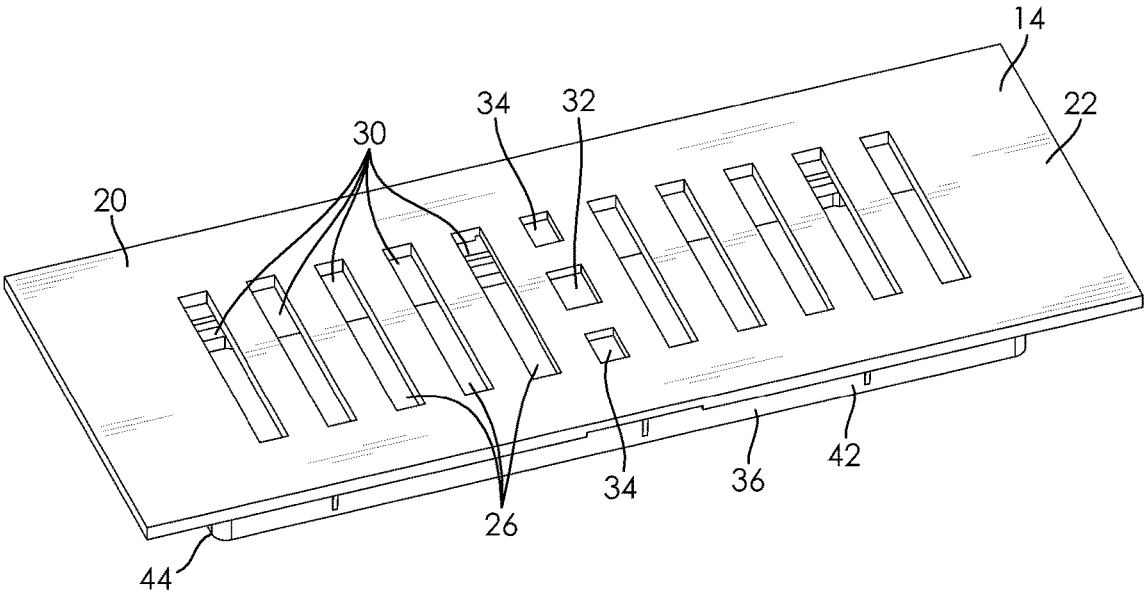
FIG. 9 shows a top perspective view of the air vent.
Figure 10:
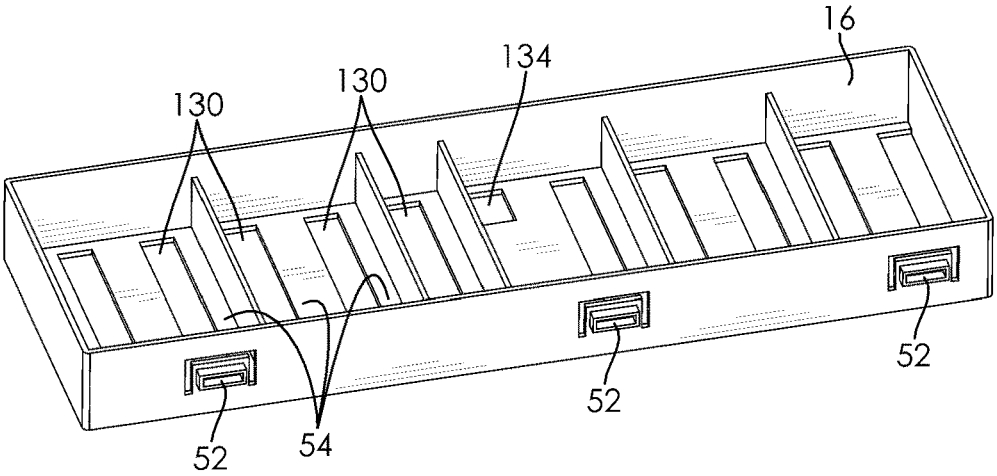
FIG. 10 shows a bottom perspective view of a slider.
Figure 16:
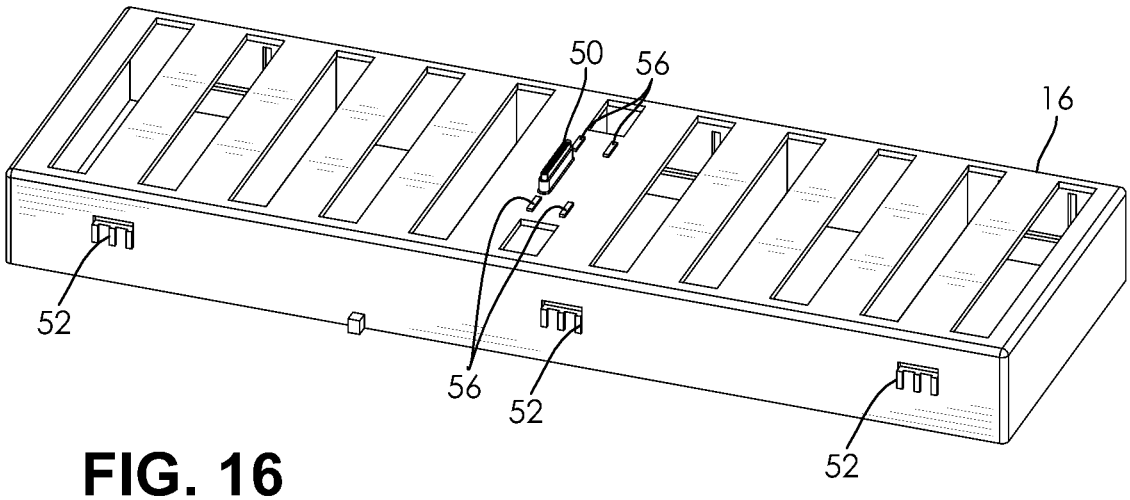
FIG. 16 shows a top perspective view of a slider with an actuator.

A variation of detents 48 can be on the top surface of a slider 16 or on the bottom of an air vent 14 as shown in FIG. 8 adjacent to the center aperture 32. As shown in FIG. 16, raised portions 56 on a slider 16 can align with detents 48 when the slider 16 is in its farthest range of motion. Such detents 48 engaging with raised portion 56 can hold the slider 16 in a set position relative to the air vent 14. Such detents 48 and raised portions 56 are preferably molded into the respective air vent 14 or slider 16.

Each parallel portion 42 of the lip 36 extends along the long portion of the floor vent assembly 12, and preferred end lips 44 may run parallel to the short edge of the floor vent assembly 12 as combined form a preferred substantially rectangular total lip 36 extending from the backside 24.

Figure 11:
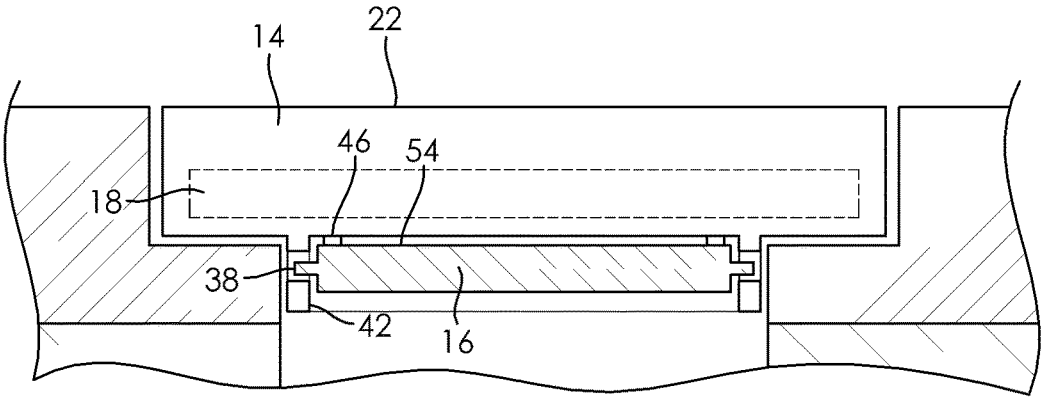
FIG. 11 shows a cross sectional view of portion of the floor vent assembly through a guide of a slider while in a slider track aperture.

As best understood from the cross sectional depiction of FIG. 11, the back side 24 preferably also includes a guide rib 46, such as 0.5 mm extending, along the inside of the parallel portions 42 of the lip 36. The guide rib 46 on the air vent 14 allows for smooth travel of the slider 16 within the slider track aperture 38.

The slider 16 also includes slots 126, 130, and 134 that functionally correspond with the slots 26, 30 and 34 of the air vent 14.

The slider 16 includes an actuator 50 that aligns with and passes through the center aperture 32 of the air vent 14. The actuator 50 is preferably integrated and molded as part of a slider 16 as a rectangular or semi-circular tab, which is large enough to push with a finger, but small enough to preferably not extend beyond the outer surface 22 of the vent cover 20. The edge of the center aperture 32 can preferably be beveled to allow easier access to the actuator 50 so the actuator 50 does not need to extend above the surface of the vent cover 20 so the entire vent cover 20 can be flush with or lower than the surrounding floor surface.

The slider 16 has guides 52 with six shown in FIGS. 6, 7, 10, and 15 that correspond with the slider track apertures 38 of the air vent 14 so that each guide 52 slides within each corresponding slider track aperture 38. The guides 52 are preferably tabs that extend from the slider 16 and move within each slider track aperture 38 when the slider 16 slides.

The actuator 50 can be in a first position that corresponds with the open position as shown in FIG. 1, but can be moved, such as by simple pushing with a finger, to a second position as shown in FIG. 2, which shows the slider 16 blocking the slots 26, 30 and 34, which restricts airflow through the floor vent assembly 12.

The actuator 50 extends through center aperture 32 so that a human operator can easily move the actuator 50 with a finger, without moving the vent cover 20, from a first position to a second position, which will move the slider 16 from a first position to a second position, wherein the first position of FIGS. 1 and 3, the slots 126, 130, and 134 align with the slots 26, 30 and 34 of the air vent 14 to allow passage of air. In the second position of FIGS. 2 and 4, the slider ribs 54 of the slider 16 slide to align with the slots 26, 30 and 34 of the air vent 14 to restrict or fully block airflow through the floor vent assembly 12.

In operation, the floor vent assembly 12 can be adjusted to selectively increase or decrease airflow by sliding the slider 16 in different positions. An example range of travel of the slider 16 is 11 mm for a slider with ten elongated slots 30 forming eight slider ribs 54 with ten elongated slows 30 as an example embodiment.

The slider 16 is also preferably injection molded, and as an example may be 2.5 mm thick. Its length may be 229.2 mm, and its width may be 95.6 mm. The slider 16 is designed to fit within the lip 36 wherein each parallel portion 42 acts as a track where each guide 52 of the slider 16 moves within a corresponding slider track aperture 38 in a parallel portion 42.

Figure 12:
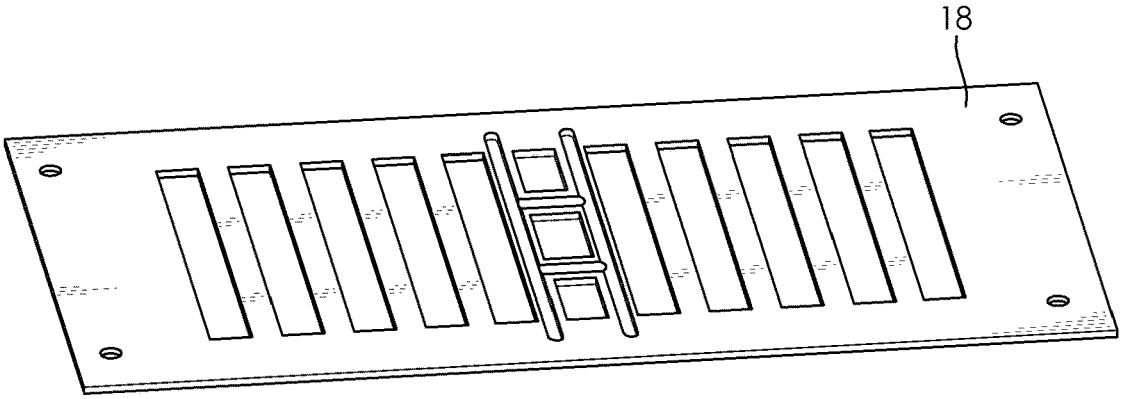
FIG. 12 shows a view of an embodiment of a support bracket.

The lip 36 surrounds the slider 16 with the parallel portions 42 corresponding with the slider 16 for slidable travel of the slider 16, and the optional end lips 44 can define the full range of movement of the slider 16 in each direction. The parallel portions 42 of the lip 36 are set inward from the longer sides of the air vent 14, and each end lip 44 is set inward from the short edge of the floor vent assembly 12 so there is area around the edges of the bottom surface wherein a support bracket 18 can be overmolded or injection molded past or beyond the lip 36 so the support strength of the support bracket 18 can rest on a flat ledge area of an opening in the floor where the HVAC duct comes to the floor for a flush-mounted floor vent assembly 12. An example size of the support bracket 18 of FIG. 12 is 302 mm×124 mm.

Figure 14:
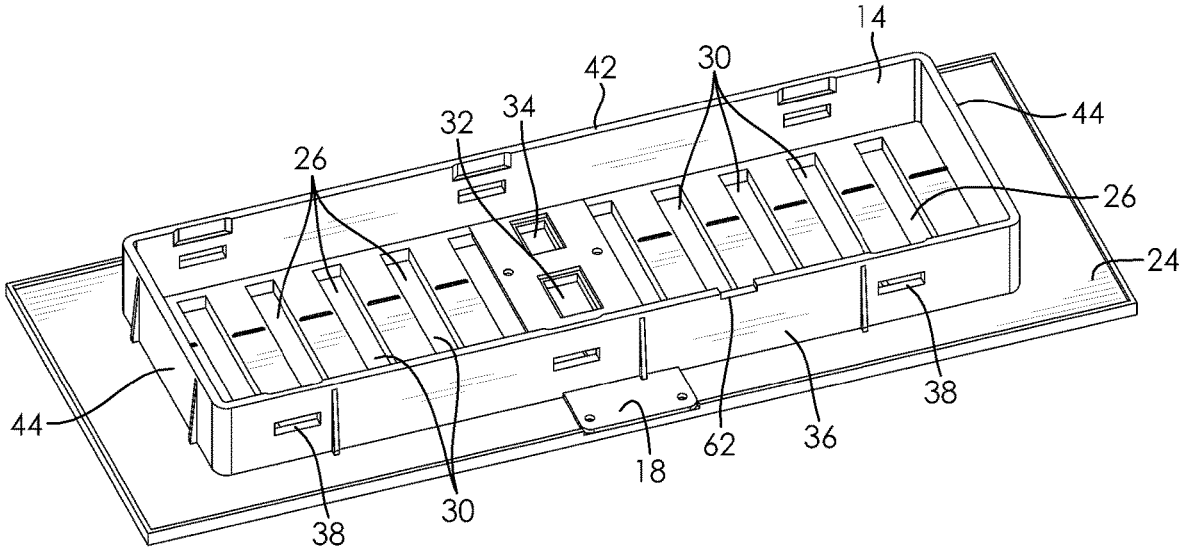
FIG. 14 shows a bottom perspective view of an air vent with a support plate molded in place.
Figure 14A:
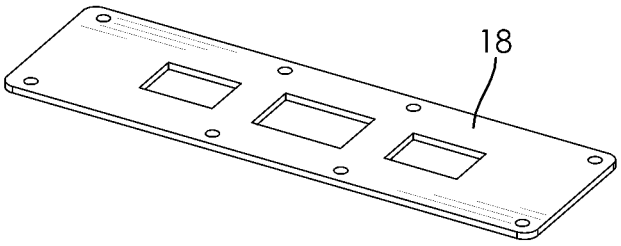
FIG. 14*a* shows the support plate.

While optional, a support bracket 18 may be a sturdy plastic insert to strengthen and reinforce the floor vent assembly 12. The support bracket 18 as shown in FIG. 12 may be a metal stamping, such as steel between 2 to 2.5 mm thick that is incorporated internally into a preferred plastic molded air vent 14, such as being over molded into the preferred injection molded in the air vent 14. The slots and ribs of the support bracket 18 if incorporated would align with the slots and ribs of the air vent 14. Another version of the support bracket 18 is shown in FIG. 14*a* as a support plate, which reinforces the middle section of the floor vent assembly 12, and that support bracket 18 extends beyond each lip 36 along each parallel portion 42, and that support bracket 18 has apertures (three as shown) as slots that align with the adjacent slots 34 and also the center aperture 32.

The top surface and the actuator 50 can be flush with or below the outer surface 22 of the vent cover 20 so that the actuator 50 will not extend above the surrounding floor surface. As shown in FIG. 16, the actuator 50 can be beveled and have a textured top surface for easier operation with a finger.

One aspect that customers prefer is choosing decorative vent covers that complement the décor of a room. The vent cover 20 can match most styles, finishes, patterns, and colors including matching wood flooring or with a colored or white coating, powder finish, or laser etching. In one embodiment, the vent cover 20 can be formed of the same materials as the surrounding floor surface. Similarly, face indicia, such as a wood pattern film, can be placed over the vent cover 20 wherein the outer surface 22 as a secured film would be the final top surface of the floor vent assembly 12. In another aspect, the vent cover 20 could be textured, painted, printed, coated, or etched to match or complement the surrounding floor surface.

An option includes scanning and creating an image using a laser printer to print right on the outer surface 22. As such, the printed image would match the floor surface that will be surrounding the floor vent assembly 12. A preferred option includes scanning wood, ceramic, or composite flooring and then printing the air vent 14 to match.

In one aspect, the vent cover 20 could be aluminum or steel, instead of the preferred molded plastic, but in meeting some of the decorative aspects, a steel plate, such as 2 to 2.5 mm thick can be integrated into the floor vent assembly 12 as a support bracket 18 to reinforce the strength of a molded air vent 14. Various types of plastic and components can be used.

Figure 5:
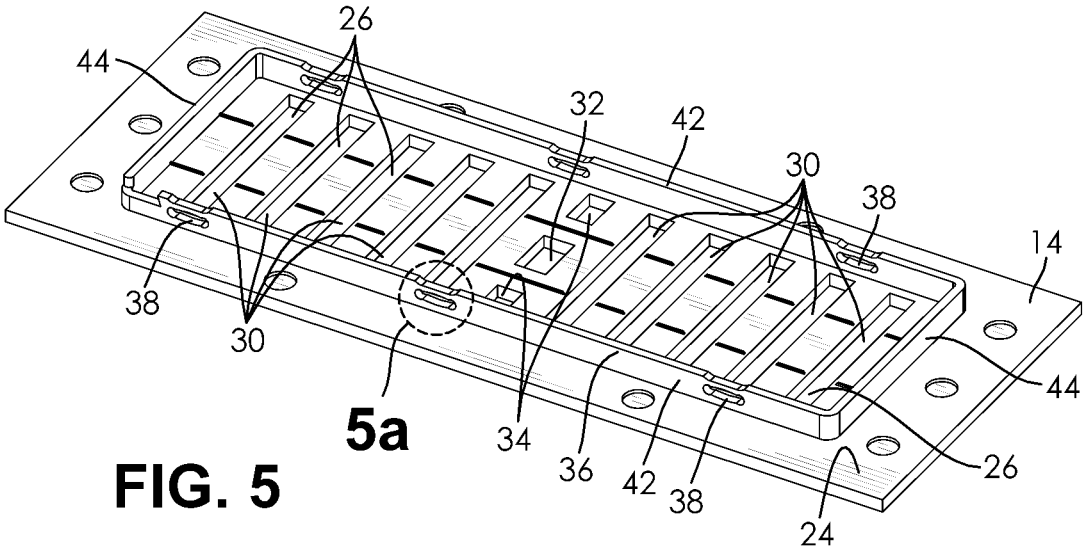
FIG. 5 shows a bottom perspective view of an air vent.
Figure 5A:
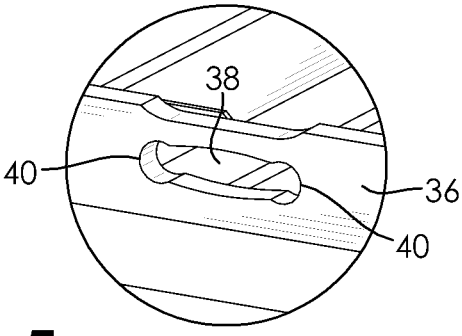
FIG. 5*a* shows a detailed portion from FIG. 5.
Figure 6:
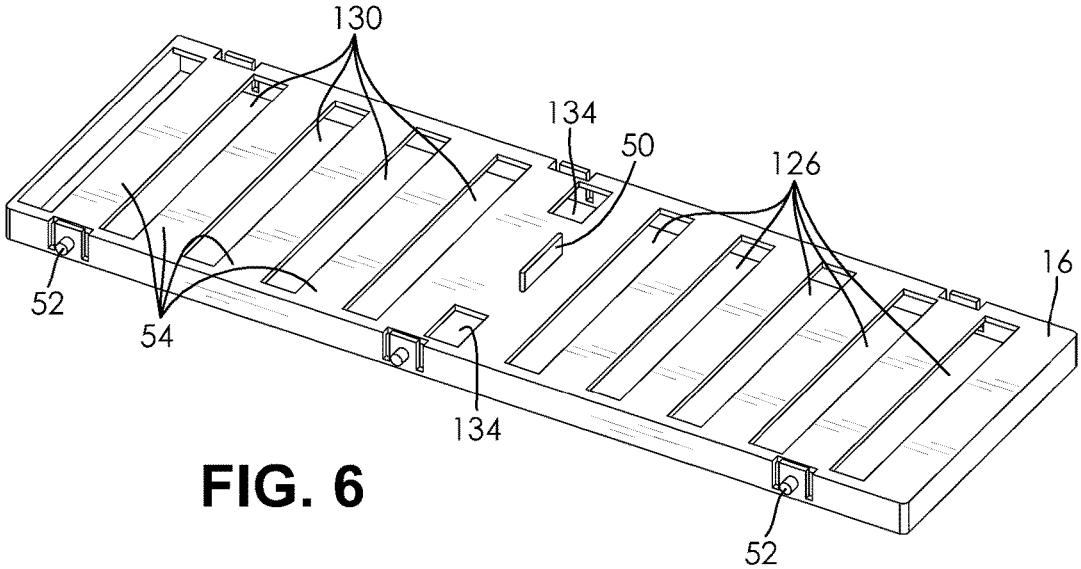
FIG. 6 shows a top perspective view of a slider with an actuator.
Figure 7:
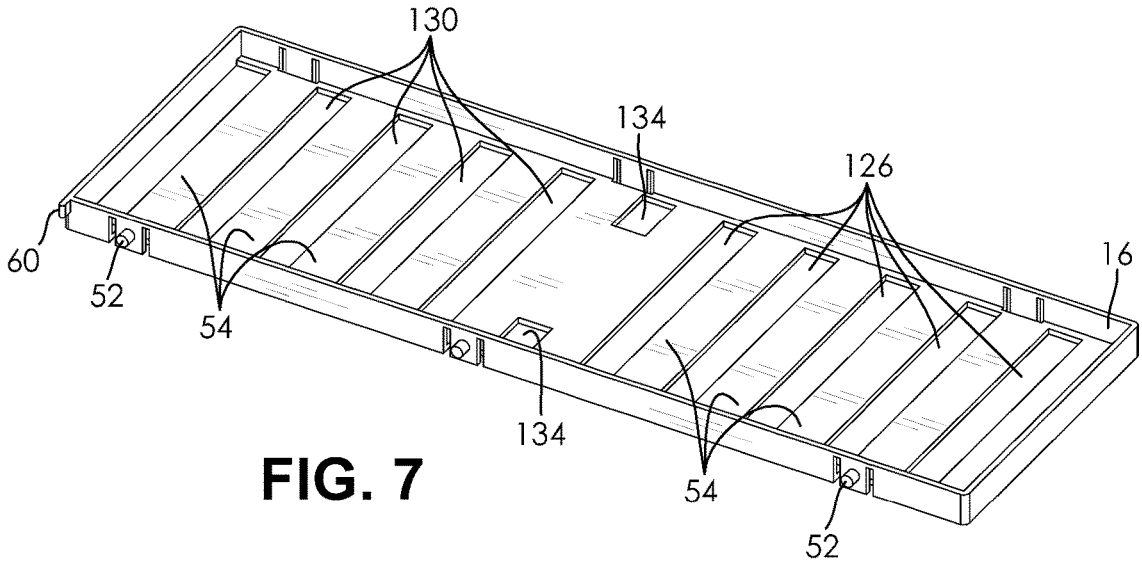
FIG. 7 shows a bottom perspective view of the slider.
Figure 13:
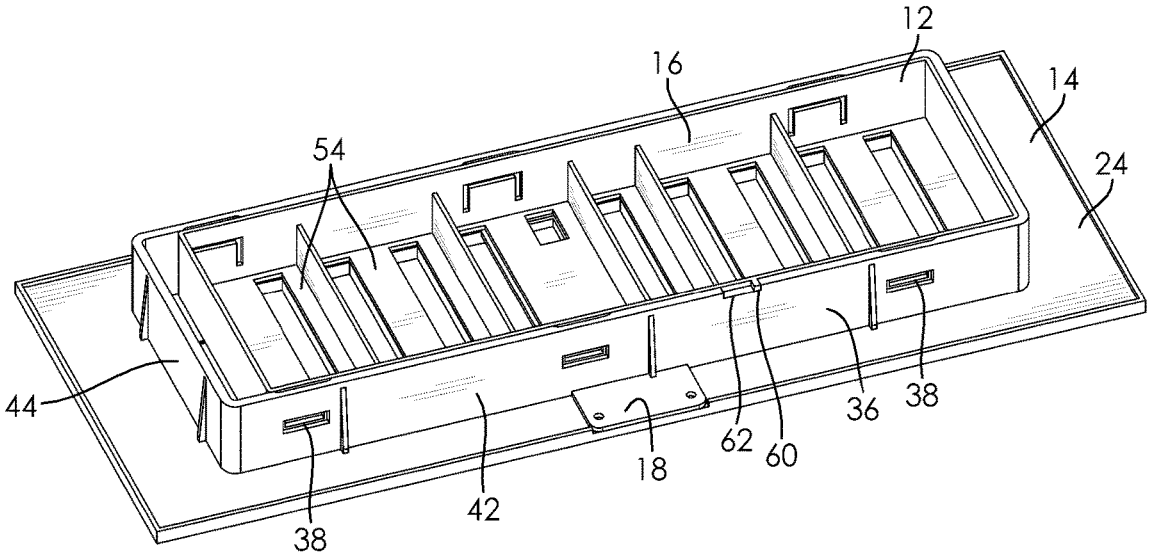
FIG. 13 shows a bottom perspective view of a preferred floor vent assembly with a support plate.
Figure 15:
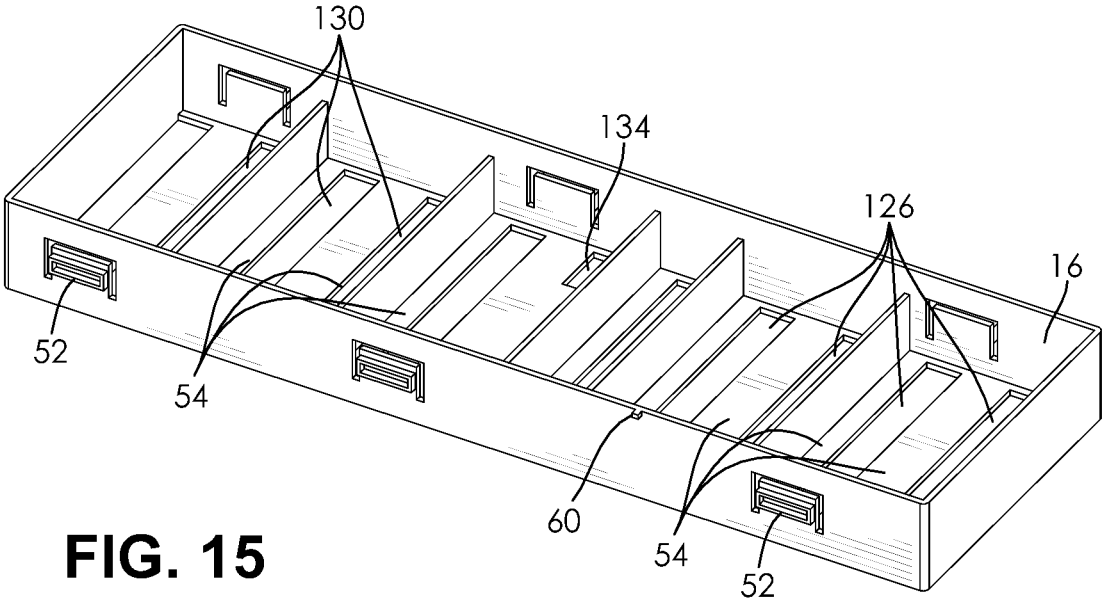
FIG. 15 shows a perspective view of a preferred slider.

As shown in FIG. 7, a tab 60 can be in a corner of a slider 16 with a corresponding recess 62, as shown in FIG. 5, instead of an aperture, in a corner of the lip 36 of the air vent 14 in this particular embodiment. Similarly, a tab 60 is shown in FIGS. 13 and 15 that correspond to recess 62 in FIGS. 13 and 14 along an edge of the lip 36, where as tab 60 slides in the recess 62 as depicted in FIG. 13. The type of tab 60 of the slider would slide along the recess 62 as the elongated track. Such a feature can help with assembly so a team member can readily align the slider 16 during assembly. This tab 60 in recess 62 can be in addition to the multiple slider track apertures 38 or an alternative to a guide 52 in a slide track aperture 38.

Optional shims can be included with each air vent 14, such as on the back side 24 extending beyond the lip 36 to accommodate (1) adjusting the height of air vent 14 to obtain the correct floor height on flush mounting, (2) sealing around perimeter when floor mounting and air leaks, and (3) preventing movement/shifting due to size of ductwork. Such shims can be a soft molded TPE/EPDM or a form piece.

In a unique sliding design of the floor vent assembly 12, the user simply utilizes the actuator 50 extending through the vent cover 20 to manually move the slider 16 within the floor vent assembly 12 where respective slots align or are offset to allow or restrict the flow of air through the floor vent assembly 12.

This disclosure has been described as having exemplary embodiments and is intended to cover any variations, uses, or adaptations using its general principles. It is envisioned that those skilled in the art may devise various modifications and equivalents without departing from the spirit and scope of the disclosure as recited in the claims. Further, this disclosure is intended to cover such variations from the present disclosure as come within the known or customary practice within the art to which it pertains.

What is claimed is:

1. A floor vent assembly comprising:

an air vent having an aperture and a plurality of slots between vent ribs, and on a back side, a lip with a series of elongated tracks; and a slider having an actuator and a plurality of slider slots with slider ribs between certain slider slots, the slider further having guides along outer rims; each guide aligned with corresponding elongated tracks to allow the slider to slide relative to the air vent, wherein the elongated tracks include a recess along the lip wherein a tab of the slider can slide along the recess and wherein the actuator passes through the aperture of the air vent for sliding the slider from a first position where the slots of the air vent align with the slider slots to allow the flow of air to a second position where the slider ribs align with the slots of the air vent to restrict the flow of air through the floor vent assembly.

2. The floor vent assembly of claim 1 further including a support bracket molded into the air vent, wherein the support bracket extends beyond the lip for reinforcement.

3. The floor vent assembly of claim 1 wherein the series of elongated tracks include slider track apertures that accommodate the guides of the slider.

4. The floor vent assembly of claim 1 wherein a surface of the slider and a bottom of the air vent include detents.

5. The floor vent assembly of claim 1 wherein the air vent has laser printing on its outer surface.

6. A floor vent assembly comprising:

an air vent having an aperture and a plurality of slots between vent ribs, and on a back side, a lip with a series of elongated tracks; and a slider having an actuator and a plurality of slider slots with slider ribs between certain slider slots, the slider further having guides along outer rims; each guide aligned with corresponding elongated tracks to allow the slider to slide relative to the air vent wherein the series of elongated tracks include slider track apertures that accommodate the guides of the slider and the slider track apertures each have a detent on each distal end of each slider track aperture and wherein the actuator passes through the aperture of the air vent for sliding the slider from a first position where the slots of the air vent align with the slider slots to allow the flow of air to a second position where the slider ribs align with the slots of the air vent to restrict the flow of air through the floor vent assembly.

7. The floor vent assembly of claim 6 wherein the air vent has laser printing on its outer surface.

8. The floor vent assembly of claim 6 further including a support bracket molded into the air vent, wherein the support bracket extends beyond the lip for reinforcement.

* * * * *